US007252194B2

(12) United States Patent
Tracy

(10) Patent No.: US 7,252,194 B2
(45) Date of Patent: Aug. 7, 2007

(54) TRASH CONTAINER LINER DISPENSER BOX INCLUDING A REINFORCING INSERT

(75) Inventor: Anthony S. Tracy, New York, NY (US)

(73) Assignee: Tracy Productions, LLC, Wall Township, NJ (US)

( * ) Notice: Subject to any disclaimer, the term of this patent is extended or adjusted under 35 U.S.C. 154(b) by 181 days.

(21) Appl. No.: 11/024,349

(22) Filed: Dec. 28, 2004

(65) Prior Publication Data

US 2006/0138149 A1 Jun. 29, 2006

(51) Int. Cl.
*B65D 85/02* (2006.01)
*B65D 85/67* (2006.01)
*B65H 18/28* (2006.01)

(52) U.S. Cl. ..... 206/395; 206/408; 242/159; 242/588.4

(58) Field of Classification Search ..... 206/389, 206/395, 408–409; 242/159–160.1, 160.3, 242/160.4, 588.3, 588.4
See application file for complete search history.

(56) References Cited

U.S. PATENT DOCUMENTS 882,557 A * 3/1908 Gathright ..... 206/408
3,237,826 A * 3/1966 Ringholz et al. ..... 206/409
5,503,292 A 4/1996 Cuccharia
5,671,847 A 9/1997 Pedersen et al.
6,283,405 B1 9/2001 Tracy
6,899,226 B2 * 5/2005 Voissem ..... 206/397
6,976,583 B2 * 12/2005 Horn ..... 206/395
2005/0098464 A1 * 5/2005 Tracy ..... 206/395

* cited by examiner

*Primary Examiner*—Bryon P. Gehman
(74) *Attorney, Agent, or Firm*—David L. Davis

(57) ABSTRACT

A dispenser for trash container liners including a rigid box containing a supply of liners in the form of a cylindrical roll of a continuous strip of liners. The liners extend through an open slot in the top of the box and the innermost liner of the roll is securely attached to a cylindrical spindle on which the liners are wound. The dispenser also includes a reinforcing insert in the form of a piece of sheet stock in a U-shape partially surrounding the roll of liners. The box is detachably secured to the bottom of the trash container and the spindle is dimensioned so as not to pass through the slot. Accordingly, when the last liner in the box is used and removed from the container, the box is removed as well.

10 Claims, 4 Drawing Sheets

TRASH CONTAINER LINER DISPENSER BOX INCLUDING A REINFORCING INSERT

BACKGROUND OF THE INVENTION

This invention relates to a dispenser box for trash container liners and, more particularly, to such a dispenser box which can be placed at the bottom of a trash container without requiring any modification to the trash container.

It is fairly common to use plastic liners, or bags, for lining the interiors of trash containers or garbage cans. The liners are frequently packaged in boxes, or in rolls. A liner is removed from the box or roll and placed in the trash container to line its interior. After the liner is filled with trash, it is removed from the trash container and discarded, and a new liner is then removed from the package and inserted into the trash container. Typically, the packages of trash can liners are stored in a closet or on a shelf, and a new liner must be obtained from the package before insertion into the trash container.

U.S. Pat. No. 5,503,292 to Cuccharia discloses a specially designed trash receptacle wherein a roll of trash can liners is contained in a holder beneath the receptacle and liners are inserted in the receptacle through a slot in the bottom thereof. While useful for its intended purpose, such an arrangement requires a special two-part receptacle and liner holder. It would therefore be desirable to have a dispenser for trash container liners which does not require the use of a specially designed trash container.

U.S. Pat. No. 5,671,847 to Pedersen et al discloses a trash bag dispenser which is placed in the bottom of a trash container. The dispenser includes a flexible pouch containing a continuous strip of liners, which are removed one at a time from the pouch while remaining removably secured to the following liner in the pouch. However, when the liner lining the trash container is filled, its weight presses down on the pouch, crushing it and interfering with its utility. It would therefore be desirable to have a dispenser for trash container liners which does not suffer from any of the deficiencies noted above.

In my U.S. Pat. No. 6,283,405, I disclose a dispenser for trash container liners which includes a rigid triangular box containing a supply of liners in the form of a cylindrical roll of a continuous strip of liners. The liners extend through an open slot in a side of the box and the box is detachably secured to the bottom of the trash container. While this construction overcomes the deficiencies noted above with respect to the other referenced patents, the triangular shape of the box does not lend itself to easy stacking, either on a sales shelf in a store or for storage of unused boxes. Further, the triangular shape does not lend itself to automated assembly. It would therefore be desirable to have a dispenser for trash container liners which retains the advantages of the construction disclosed in my '405 patent and in addition is configured for stackability, as well as being amenable to automated assembly.

SUMMARY OF THE INVENTION

According to the present invention, there is provided a dispenser for trash container liners which comprises a rigid box having a longitudinal axis and a generally square shape when viewed in section transverse to the longitudinal axis. The square shape has a base side, an opposing top side which is parallel to the base side, and a pair of lateral sides which are orthogonal to the top side and to the base side. The top side is formed with an open slot elongated in a direction parallel to the longitudinal axis. A supply of liners is contained within the interior of the box, the supply of liners being in the form of a roll of a continuous strip of liners separated one from the next by a line of perforations. Accordingly, the liners are removable from the box one-by-one through the open slot. The dispenser box also includes a reinforcing insert in the form of a U-shaped member partially surrounding the roll of liners.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
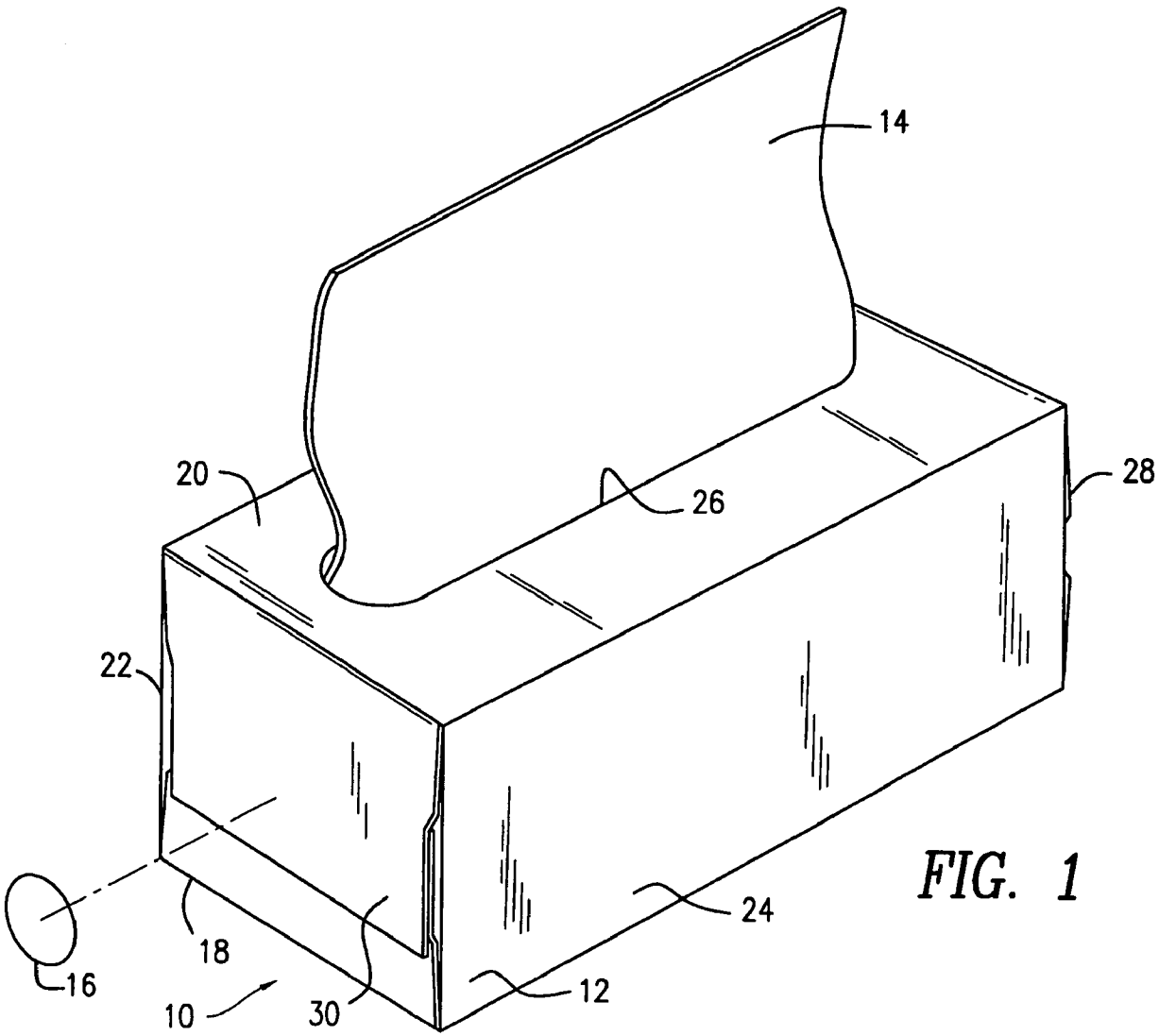
FIG. 1 is a perspective view of a dispenser constructed according to the present invention.
Figure 3:
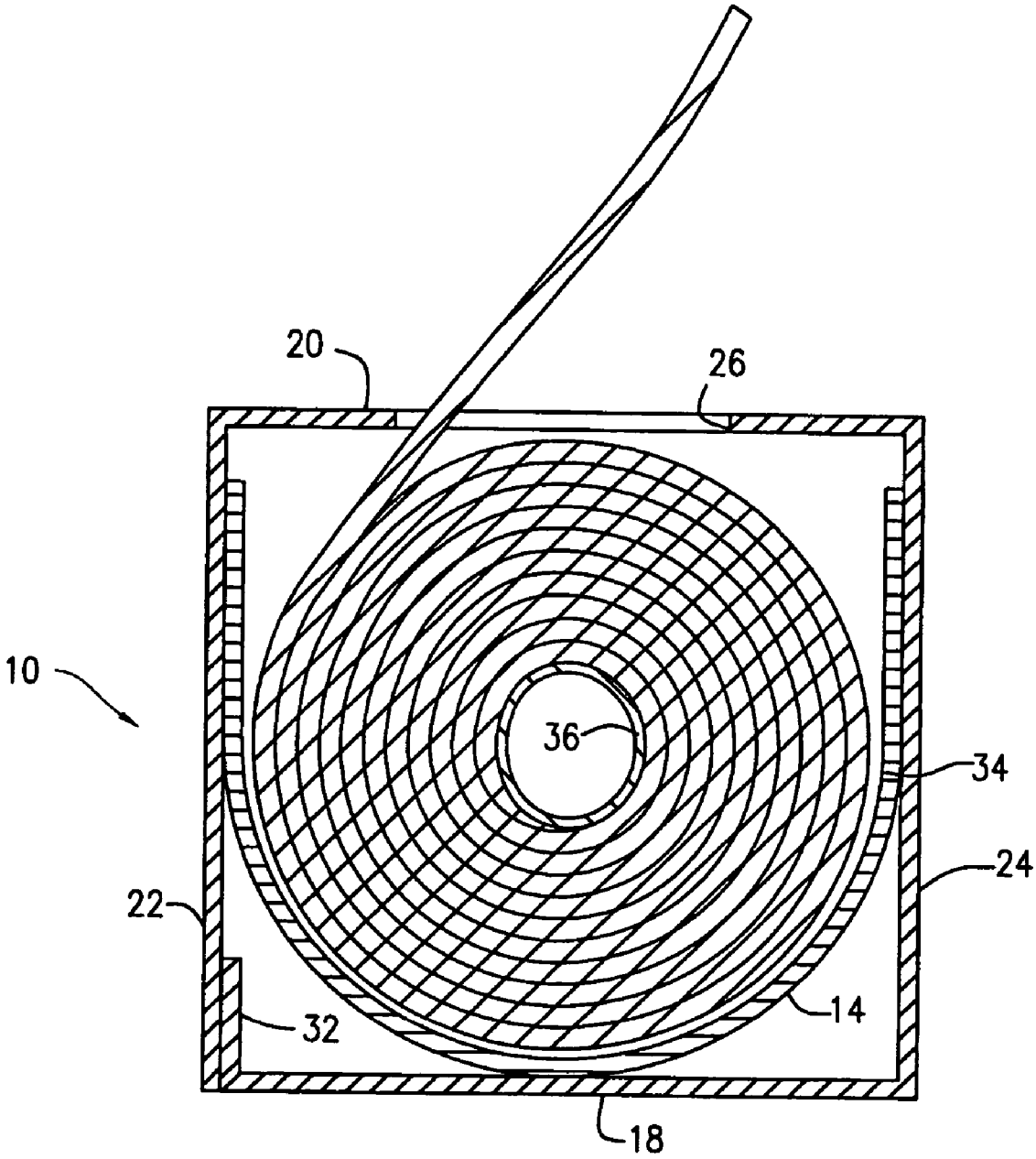
FIG. 3 is a cross sectional view of the dispenser shown in FIG. 1, taken transverse to the longitudinal axis of the dispenser box.

Referring now to the drawings, FIG. 1 shows a dispenser, designated generally by the reference numeral 10, constructed in accordance with the present invention. The dispenser 10 includes a rigid box 12 and a supply of plastic liners 14 within the box 12. As shown, the box 12 has a longitudinal axis 16. When viewed in section transverse to the axis 16, as shown in FIG. 3, the box 12 has a generally square shape with a base side 18, a top side 20, and a pair of lateral sides 22,24. The top side 20 is parallel to the base side 18 and the pair of lateral sides 22,24 are orthogonal to the top side 20 and to the base side 18. The top side 20 of the box 12 is formed with an open slot 26, elongated in a direction parallel to the longitudinal axis 16, through which the liners 14 can be removed from the interior of the box 12.

Figure 2A:
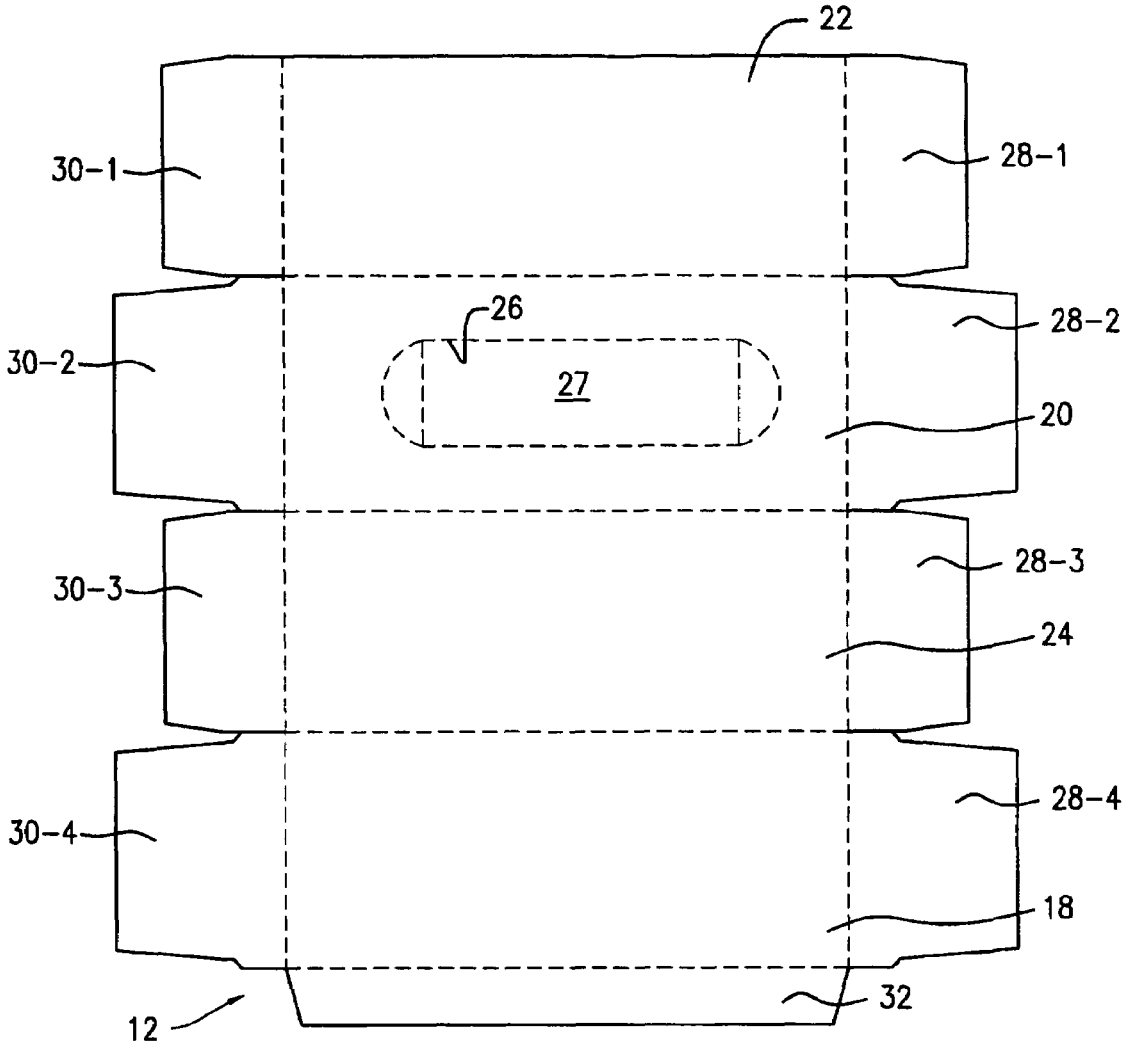
FIG. 2A is a plan view showing a piece of sheet stock cut to form the box of the dispenser shown in FIG. 1, with the fold lines being shown as broken lines.

Preferably, the box 12 is formed from a stiff corrugated cardboard material which, as seen from FIG. 2A, is of unitary construction, being cut, folded and glued from a single sheet of material. Thus, the single panels 18, 20, 22 and 24 make up the correspondingly numbered sides of the box 12. The panels 28-1, 28-2, 28-3 and 28-4 together make up a first end 28 of the box 12 and the panels 30-1, 30-2, 30-3 and 30-4 together make up a second end 30 of the box 12. The open slot 26 is formed by removal of the panel 27 at its peripheral perforations. As shown in FIG. 3, the panel 32 is glued to the interior of the lateral side panel 22.

Figure 2B:
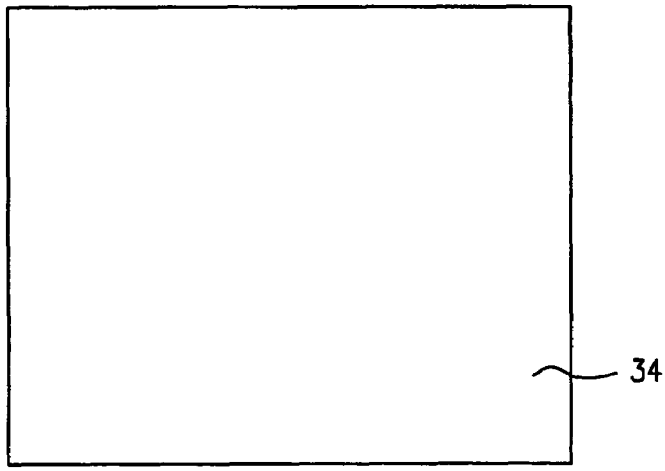
FIG. 2B is a plan view showing a piece of sheet stock cut to form the reinforcing insert.

The dispenser 10 also includes a reinforcing insert 34 in the form of a U-shaped member partially surrounding the roll of liners 14 within the box 12, as shown in FIG. 3. As shown in FIG. 2B, the insert 34 is preferably formed from a rectangular piece of sheet stock, illustratively from the same material used to form the box 12.

The liners 14 are conventionally manufactured as a continuous strip, wherein the bottom of one liner is separated from the top of the next liner in the strip by a line of perforations, so that individual liners can be separated from the strip. The strip of liners is then pleated and formed into a cylindrical roll. If desired, a cylindrical spindle 36 can be provided and the continuous strip of liners 14 would be wound thereon. The innermost liner would be firmly secured to the spindle 36, as by adhesive, staples, or the like. For assembly, the box 12 is supplied by the box manufacturer with the panels 22 and 32 glued together and with the box flattened. The box 12 is opened to expose its interior and the roll of liners 14 and the insert 34 are inserted into the open interior of the box 12 with the cylindrical roll of liners 14 being parallel to the longitudinal axis 16 of the box 12, as shown in FIG. 3. The insert 34 takes on a U-shape to partially surround the roll of liners 14, with the open side of the U-shape facing the top side 20 of the box 12. The ends 28 and 30 of the box 12 are then sealed.

The reinforcing insert 34 functions to provide added stability to the box 12 and prevent it from being crushed by the weight of a filled liner. It also assists in providing a smooth surface to allow the roll of liners 14 to easily rotate when a fresh liner is being dispensed.

Figure 5:
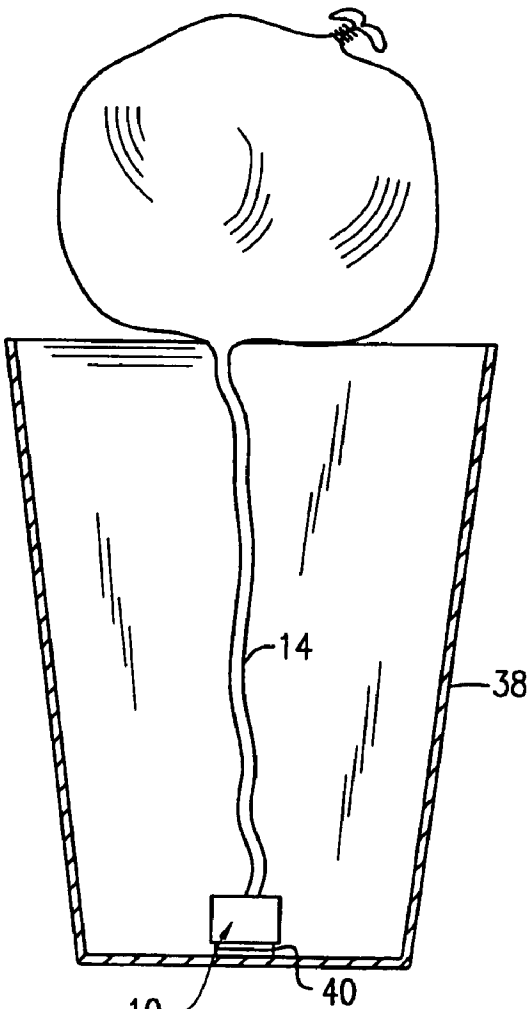
FIG. 5 is a view similar to FIG. 4 showing a filled liner being removed from the trash container with a subsequent liner being pulled from the inventive dispenser.
Figure 4:
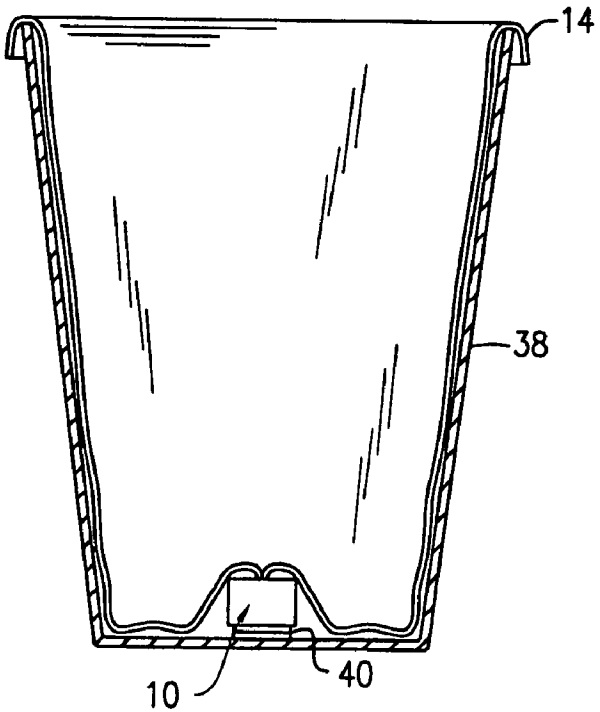
FIG. 4 is a view showing the dispenser according to the present invention mounted at the bottom of a trash container, shown in section, with a liner disposed for use.

In use, as shown in FIGS. 4 and 5, the dispenser 10 is placed at the bottom of a trash container 38. Preferably, the base side 18 of the dispenser 10 is detachably secured to the inside bottom of the container 38, illustratively by an adhesive backed hook and loop fastener set 40. With the dispenser 10 at the bottom of the container 38, a single liner can be pulled out of the box 12 through the slot 26 and its open end is draped over the open top of the container 38 so as to provide a liner for the container 38. After the liner 14 is filled, its top is closed and the entire liner is lifted from the container 38. Since the bottom of that liner is attached to the top of the next liner in the roll, the next liner is pulled from the box 12. The filled liner and the fresh liner may then be separated one from the other at the line of perforations therebetween, and the top of the next liner may then be draped over the top of the container 38, as shown in FIG. 4.

Preferably, the spindle 36 is dimensioned so that it cannot pass through the slot 26 of the box 12. Therefore, when the last liner of the dispenser 10 is filled and pulled out of the container 38, since its bottom is firmly secured to the spindle 36 and the spindle 36 cannot pass through the slot 26, the box 12 is removed from the bottom of the container 38 by separation of the hook and loop fastener set 40. Thus, removal of the last liner results in removal of the empty box. A fresh dispenser may then be installed in the trash container 38. The use of a spindle 36 would be in conjunction with bags which are used to line large trash containers, such as a homeowner would keep in his/her garage, since it may prove to be difficult for the homeowner to reach all the way down to the bottom of the large container to remove the empty box. However, the homeowner could still drop a new box into the container so that the hook and loop fastener set 40 secures the box to the bottom of the container. The weight of a filled liner would aid in the securement of the hook and loop fastener set 40.

Accordingly, there has been disclosed an improved dispenser for trash container liners. While a preferred embodiment of the present invention has been disclosed herein, it will be appreciated by those of skill in the art that various adaptations and modifications to the disclosed embodiment are possible, and it is therefore intended that this invention be limited only by the scope of the appended claims. Thus, the present invention can be manufactured in many different sizes, to fit different size conventional trash containers, without requiring the use of a specially designed container.

What is claimed is:

1. A dispenser for trash container liners, comprising:

a rigid box having a longitudinal axis and a generally square shape when viewed in section transverse to said longitudinal axis, said square shape having a base side, an opposing top side which is parallel to said base side, and a pair of lateral sides which are orthogonal to said top side and to said base side, with said top side being formed with an open slot elongated in a direction parallel to said longitudinal axis;

a supply of liners contained within the interior of said box, said supply of liners being in the form of a roll of a continuous strip of liners separated one from the next by a line of perforations; and a reinforcing insert in the form of a U-shaped member partially surrounding the roll of liners and in contact with the base side and the pair of lateral sides of the box, wherein the U-shaped member is separate from the box and is unattached to the box;

whereby the liners are removable from the box one-by-one through the open slot.

2. The dispenser according to claim 1, wherein the continuous strip of liners is formed as a cylindrical roll of liners having an axis parallel to the longitudinal axis of the box.

3. The dispenser according to claim 2, further including a cylindrical spindle, wherein the roll of liners is wound on the spindle.

4. The dispenser according to claim 3, wherein the innermost liner of the roll of liners is firmly secured to the spindle.

5. The dispenser according to claim 4, wherein the spindle is dimensioned so that it cannot pass through the open slot of the top side of the box.

6. The dispenser according to claim 1, further comprising:

means for detachably securing the base side of the box to the inside bottom of a trash container.

7. The dispenser according to claim 6, wherein the means for detachably securing includes a hook and loop fastener set.

8. The dispenser according to claim 1, wherein the reinforcing insert is formed from a piece of sheet stock.

9. The dispenser according to claim 8, wherein the reinforcing insert is formed from a rectangular piece of sheet stock.

10. The dispenser according to claim 9, wherein the reinforcing insert and the box are formed from the same material.

* * * * *